US005611113A

United States Patent [19]

Röck et al.

[11] Patent Number: 5,611,113

[45] Date of Patent: Mar. 18, 1997

[54] FRAME HINGE WITH PERPENDICULAR HINGE AND ARTICULATION AXES

[75] Inventors: Erich Röck, Höchst, Austria; Fredi Dubach, Adetswil, Switzerland

[73] Assignee: Julius Blum Gesellschaft m.b.H., Höchst, Austria

[21] Appl. No.: 558,477

[22] Filed: Nov. 16, 1995

[30] Foreign Application Priority Data

Nov. 17, 1994 [AT] Austria ..... 2127/94

[51] Int. Cl.[6] ..... E05D 7/04

[52] U.S. Cl. ..... 16/246; 16/235; 16/238

[58] Field of Search ..... 16/246, 247, 248, 16/243, 245, 235, 236, 238, 237, 382

[56] References Cited

U.S. PATENT DOCUMENTS

| | | | |
|---|---|---|---|
| 3,965,530 | 6/1976 | Rock et al. | 16/237 |
| 4,290,167 | 9/1981 | Lautenschläger . | |
| 4,313,239 | 2/1982 | Tsuneki | 16/236 |
| 4,385,416 | 5/1983 | Brüstle et al. . | |
| 4,411,045 | 10/1983 | Röck et al. . | |
| 4,800,621 | 1/1989 | Rock et al. | 16/235 |
| 5,056,189 | 10/1991 | Brustle et al. | 16/238 |
| 5,056,190 | 10/1991 | Rock et al. | 16/246 |

FOREIGN PATENT DOCUMENTS

| | | | |
|---|---|---|---|
| 369490 | 1/1983 | Austria . | |
| 2217383A | 10/1989 | United Kingdom | 16/248 |

OTHER PUBLICATIONS

Co-pending U.S. Application Ser. No. 08/558,479, filed Nov. 16, 1995, Fredi Dubach et al., entitled "Frame Hinge".

*Primary Examiner*—Chuck Y. Mah
*Attorney, Agent, or Firm*—Wenderoth, Lind & Ponack

[57] ABSTRACT

A frame hinge has a hinge arm which may be secured to a furniture frame and is connected by way of at least one articulation pin to a hinge pot which may be set in a door leaf. The hinge arm is secured to the furniture frame by a base plate. Arranged between the hinge arm and the base plate is an intermediate plate which is held against the base plate by a clamping screw and is articulatedly connected to the hinge arm. The axis of the articulation is aligned perpendicular to the hinge axis and perpendicular to the plane of the closed door leaf. A gap-adjusting screw is held in the base plate and is supported by its thread either in the hinge arm or in the intermediate plate, with the result that when the gap-adjusting screw is turned the hinge arm and the intermediate plate perform an angular movement in relation to one another.

30 Claims, 8 Drawing Sheets

FRAME HINGE WITH PERPENDICULAR HINGE AND ARTICULATION AXES

BACKGROUND OF THE INVENTION

The invention relates to a frame hinge having a hinge arm which may be secured to a furniture frame and which is connected by way of at least one articulation pin to a hinge pot which may be set in a door leaf. The hinge arm is secured to the furniture frame by means of a base plate. Arranged between the hinge arm and the base plate is an intermediate plate which is held against the base plate by means of a securing screw, preferably constructed as a clamping screw, and is connected to the hinge arm.

Usually, a hinge arm is mounted on a side wall of an article of furniture by means of a base plate. In such case, an intermediate plate which provides a further possibility of adjustment of the hinge arm may be provided in order to compensate for any inaccuracies occurring when securing holes for the base plate are drilled. An example of a hinge of this type is disclosed by AT-PS 369 490.

Items of furniture are known, sold in particular in the U.S.A., which have such thin side walls that no furniture fittings can be mounted thereon. Such an item of furniture is provided at the front with a frame which carries furniture fittings, for example hinges and supporting rails for pull-out guide assemblies. Conventional hinges cannot be mounted on a frame of this type, since they project too far into the furniture. For items of furniture of this type, suitable frame hinges have been developed. A frame hinge of this type is disclosed in U.S. Pat. No. 4,385,416.

SUMMARY OF THE INVENTION

It is the object of the invention to provide an improved frame hinge of the type mentioned above, whereby adjustment of the position of the door leaf, in particular in the direction of the width of the door joint, is possible. Advantageously, it should be possible to adjust the door leaf in three dimensions.

This object according to the invention is achieved in that the intermediate plate is articulatedly connected to the hinge arm. The axis of such articulation is aligned perpendicular or orthogonal to the hinge axis and perpendicular to the plane of the closed door leaf. Held in the base plate is a gap-adjusting screw which is borne by means of its thread either in the hinge armor in the intermediate plate, with the result that when the gap-adjusting screw is turned the hinge arm and the intermediate plate perform an angular movement in relation to one another.

The invention takes as its starting point the fact that a door leaf is secured to the furniture frame by means of at least two hinges. This ensures that the hinge arms always remain aligned parallel to the furniture frame while the intermediate plates are being tilted during gap adjustment of the hinges.

BRIEF DESCRIPTION OF THE DRAWINGS

An embodiment of the invention will be described in detail below with reference to the attached drawings, wherein.

DETAILED DESCRIPTION OF THE INVENTION

Figure 1:
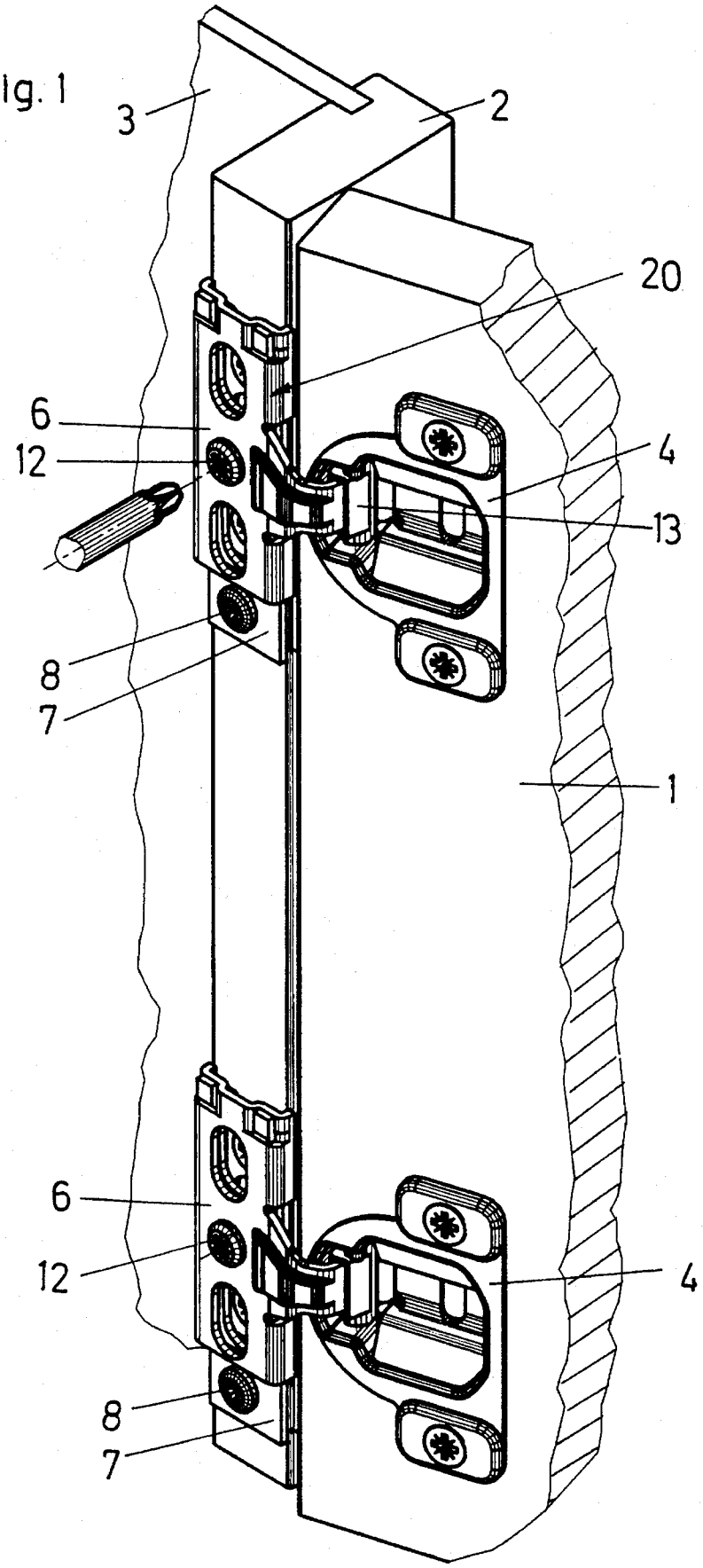
FIG. 1 is a perspective view of a portion of a furniture frame and a door leaf secured thereto by means of two hinges.
Figure 2:
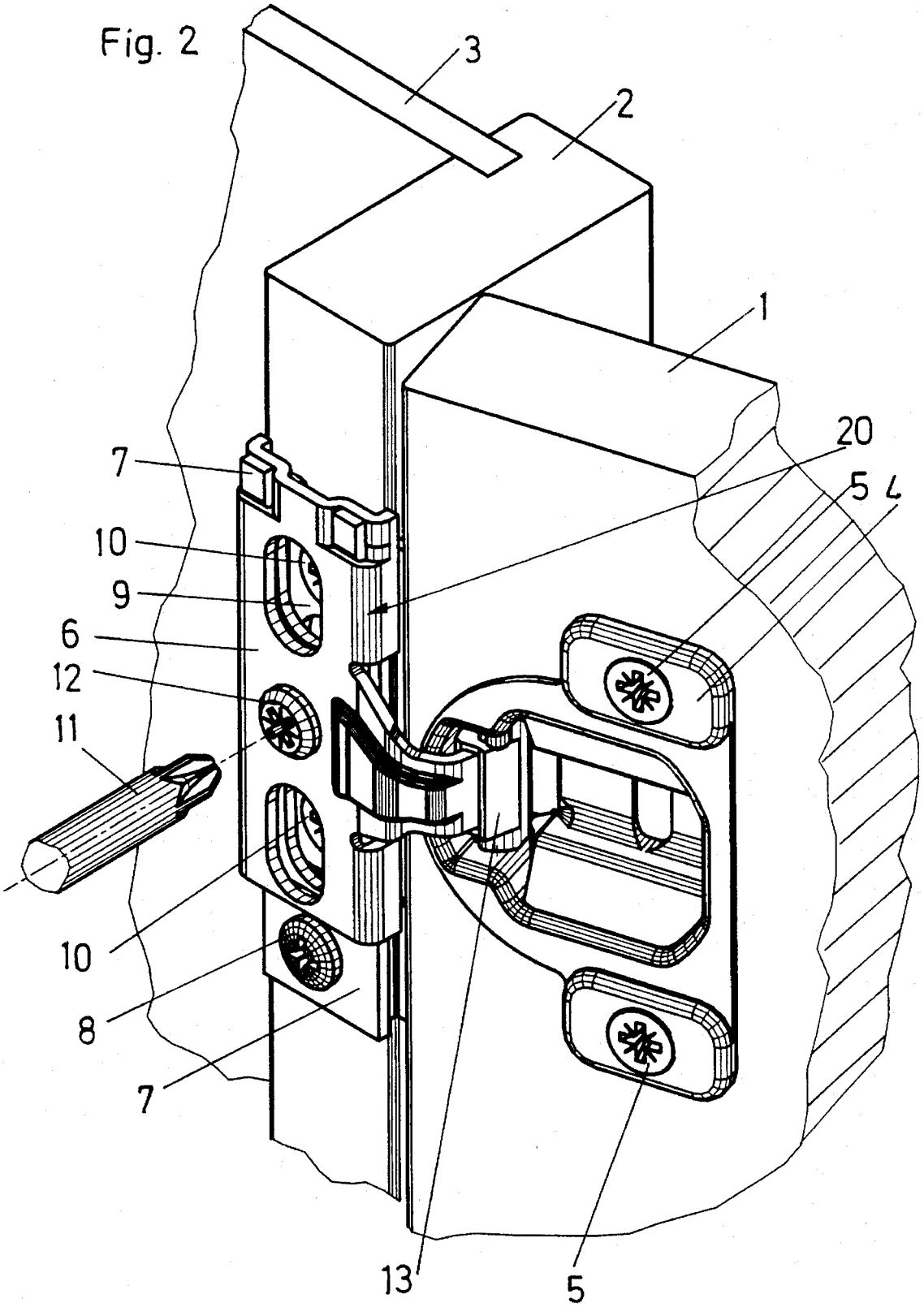
FIG. 2 is a similar view, on a larger scale, of a hinge according to the invention.
Figure 3:
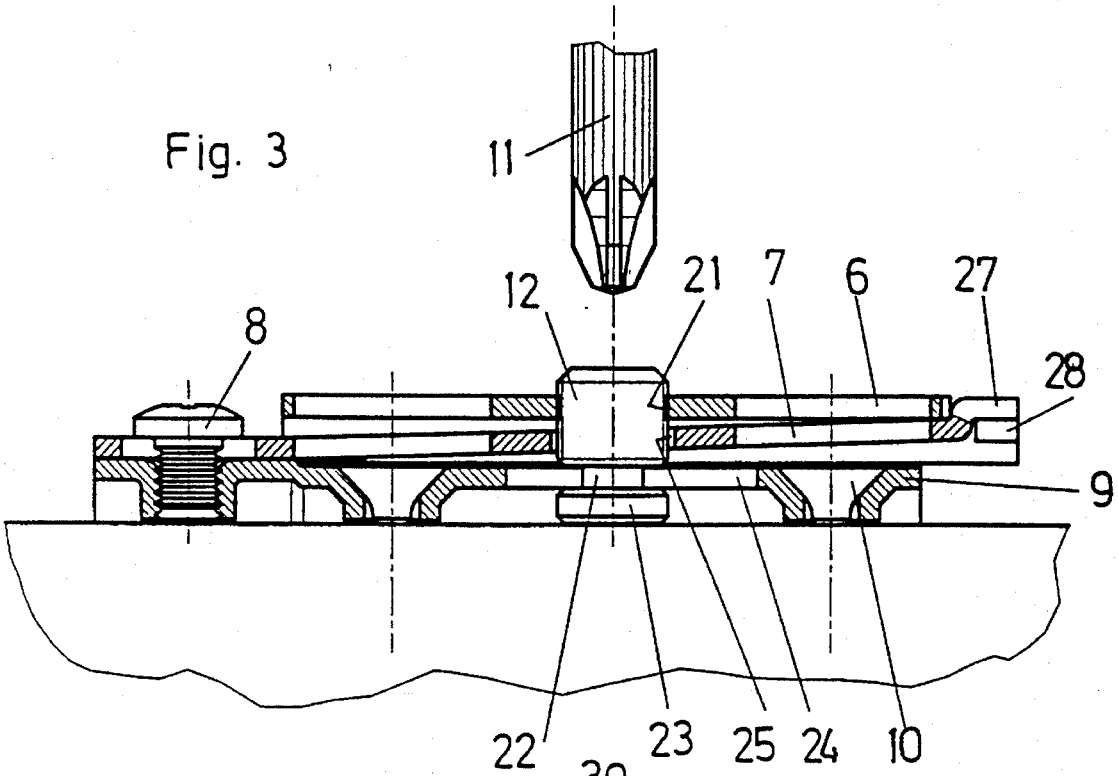
FIG. 3 is a vertical section through a hinge according to FIGS. 1 and 2.
Figure 4:
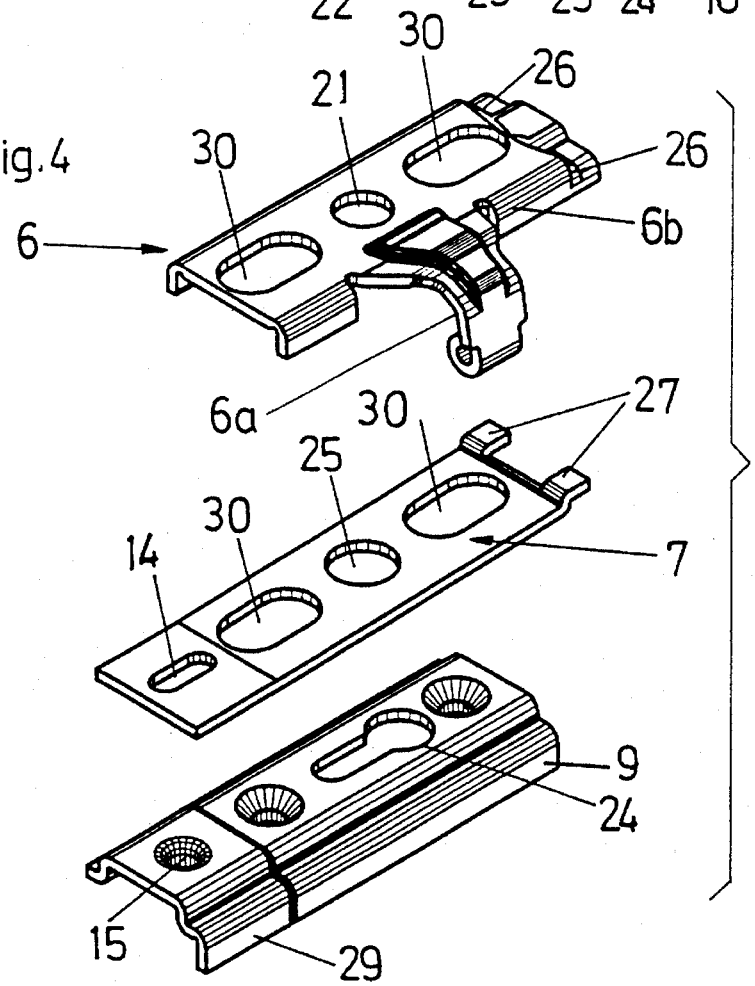
FIG. 4 is an exploded view of a hinge arm, an intermediate plate and a base plate of a hinge according to FIGS. 1 to 3.

In the embodiment of FIGS. 1–3, a door leaf is shown by reference numeral 1, a furniture frame is shown by reference numeral 2 and a furniture side wall is shown by reference numeral 3.

The door leaf 1 is mounted on the furniture frame 2 by means of at lest two hinges 20. Each hinge 20 has a hinge pot 4 which may be set in a bore in the door leaf 1 and which is connected to a hinge arm 6 by way of an articulation or pivot pin 13. The hinge arm 6 is mounted on the furniture frame 2 by way of an intermediate plate 7 and a base plate 9.

The intermediate plate 7 is held in clamped manner on the base plate 9 by means of a clamping screw 8 which projects through an elongated hole 14 in the intermediate plate and is held in a female thread 15 in the base plate 9. In the mounted position, the elongated hole 14 extends vertically, so that by releasing the clamping screw 8 and displacing the intermediate plate 7 together with the hinge arm 6 it is possible to adjust the height of the hinge 20.

A gap-adjusting screw 12 is threaded in a female thread 21 of the hinge arm 6. The gap-adjusting screw 12 has a tapered or reduced diameter neck 22 and is suspended by means of a head 23 in a keyhole 24 in the base plate 9. The gap-adjusting screw 12 at the same time projects through a hole 25 in the intermediate plate 7. The hinge arm 6 is provided with slots 26 in which are suspended projecting hooks 27 on the base plate 7. The hooks 27 and edges 28 of the hinge arm 6 delimiting the slots 26 are angled or bent in opposite directions, with the result that the hinge arm 6 and the intermediate plate 7 can bear snugly against one another.

To set a gap width, the gap-adjusting screw 12 is turned by means of an adjusting tool, for example Phillips screwdriver 11, as a result of which the hinge arm 6 is raised toward or away from the base plate 9. Since the hinge arms 6 are connected by way of the hinge pots 4 to the door leaf 1 and to one another, the hinge arms 6 always remain parallel to the furniture frame 2 during adjustment. However, an angular adjustment occurs between the intermediate plates and the hinge arms 6 due to the articulation permitted by hooks 27 fitting in slots 26.

The base plate 9 is secured to the furniture frame by means of securing screws 10. Base plate 9 has a lateral web 29 which bears laterally against the furniture frame 2. On the one hand, this ensures the precise vertical alignment of the base plate 9, and on the other hand provides an additional grip when the weight of the door leaf 1 is transmitted to the base plates 9. The intermediate plate 7 and the hinge arm 6 are provided with elongated holes 30 which enable the screwdriver 11 to access the securing screws 10. Hinge arm 6 is T-shaped and includes a base leg 6*a* supporting pivot pin 13 defining the hinge axis and a cross leg 6*b* supporting the articulation axis.

Figure 5:
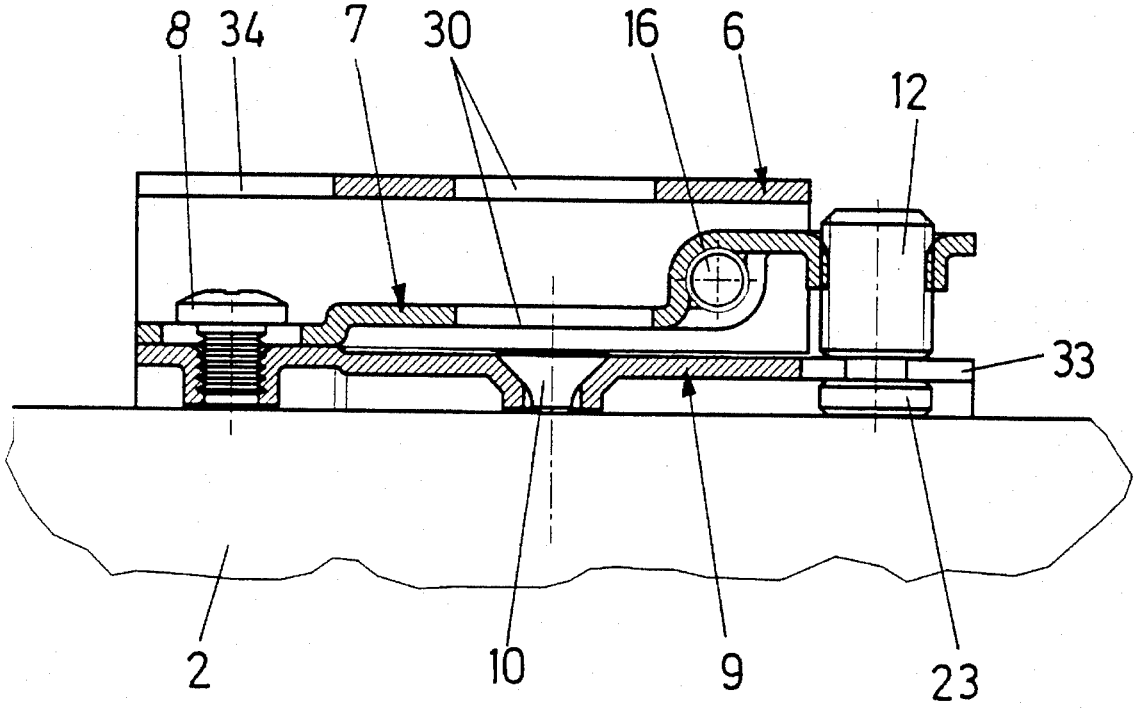
FIG. 5 is a vertical section through a further embodiment of the hinge according to the invention.
Figure 6:
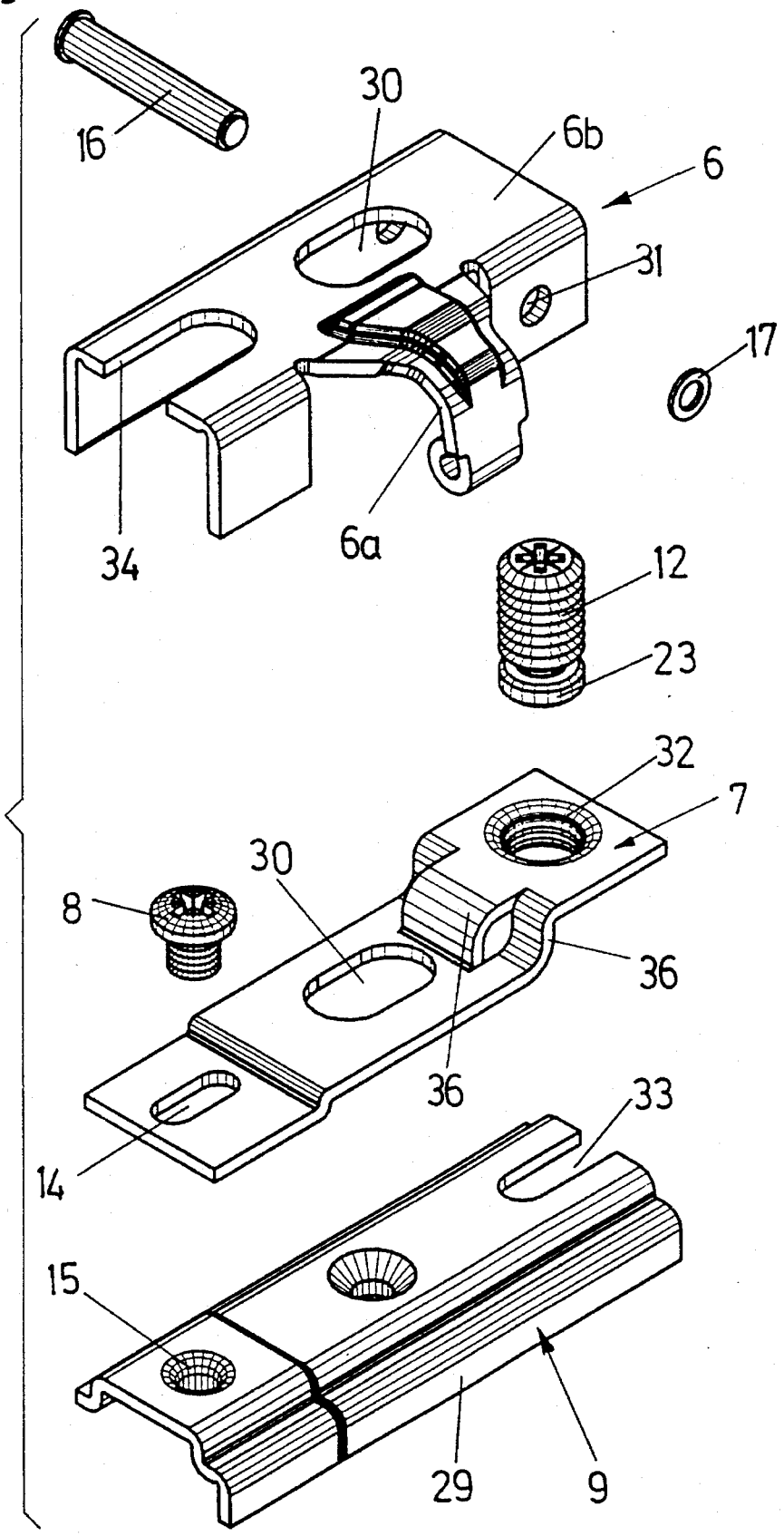
FIG. 6 is an exploded view of a hinge arm, an intermediate plate and a base plate of the hinge according to FIG. 5.

In the embodiment according to FIGS. 5 and 6, the hinge arm 6 is mounted on the intermediate plate 7 by way of a pin 16. The pin 16 projects through holes 31 in side webs of the hinge arm 6 and between bent apart tabs 36 defining an opening through intermediate plate 7 and is fixed by means of a washer 17. The gap-adjusting screw 12 is threaded in a female thread 32 in intermediate plate 7. Screw 12 has a tapered neck and is suspended by means of a head 23 in an upwardly open slot 33 in base plate 9. The intermediate plate 7 is held in clamped manner on the base plate 9 by means of a clamping screw 8 which is threaded in a female thread 16 in the base plate 9 and projects through a vertical elongated hole 14 in the base plate 7. By loosening the clamping screw 8 and displacing the hinge arm 6 and the intermediate plate 7 over the height of the elongated hole 14, it is possible to adjust the height of the hinge 20.

The base plate 9 is secured to the furniture frame 2 by means of a securing screw 10, and the intermediate plate 7 and the hinge arm 6 have elongated holes 30 which enable a screwdriver 11 to access the securing screw 10. The hinge arm 6 is, moreover, provided with a downwardly open slot 34 which enables a screwdriver to access the clamping screw 8. By turning the gap-adjusting screw 12, the intermediate plate 7 is tilted in relation to the base plate 9 and the hinge arm 6. The hinge arms 6, which are again connected to the door leaf 1 by way of the hinge pots 4, remain aligned parallel to the furniture frame 2 during such adjustment due to the articulation provided by pin 16.

Figure 7:
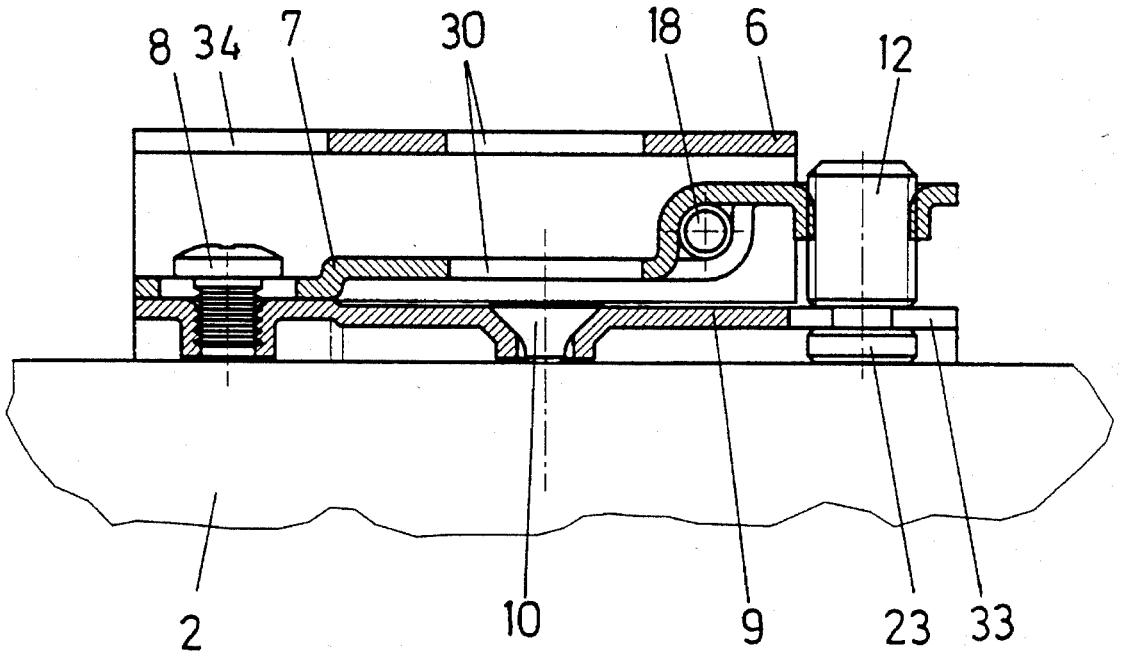
FIG. 7 is a vertical section through a further embodiment of a hinge according to the invention.
Figure 8:
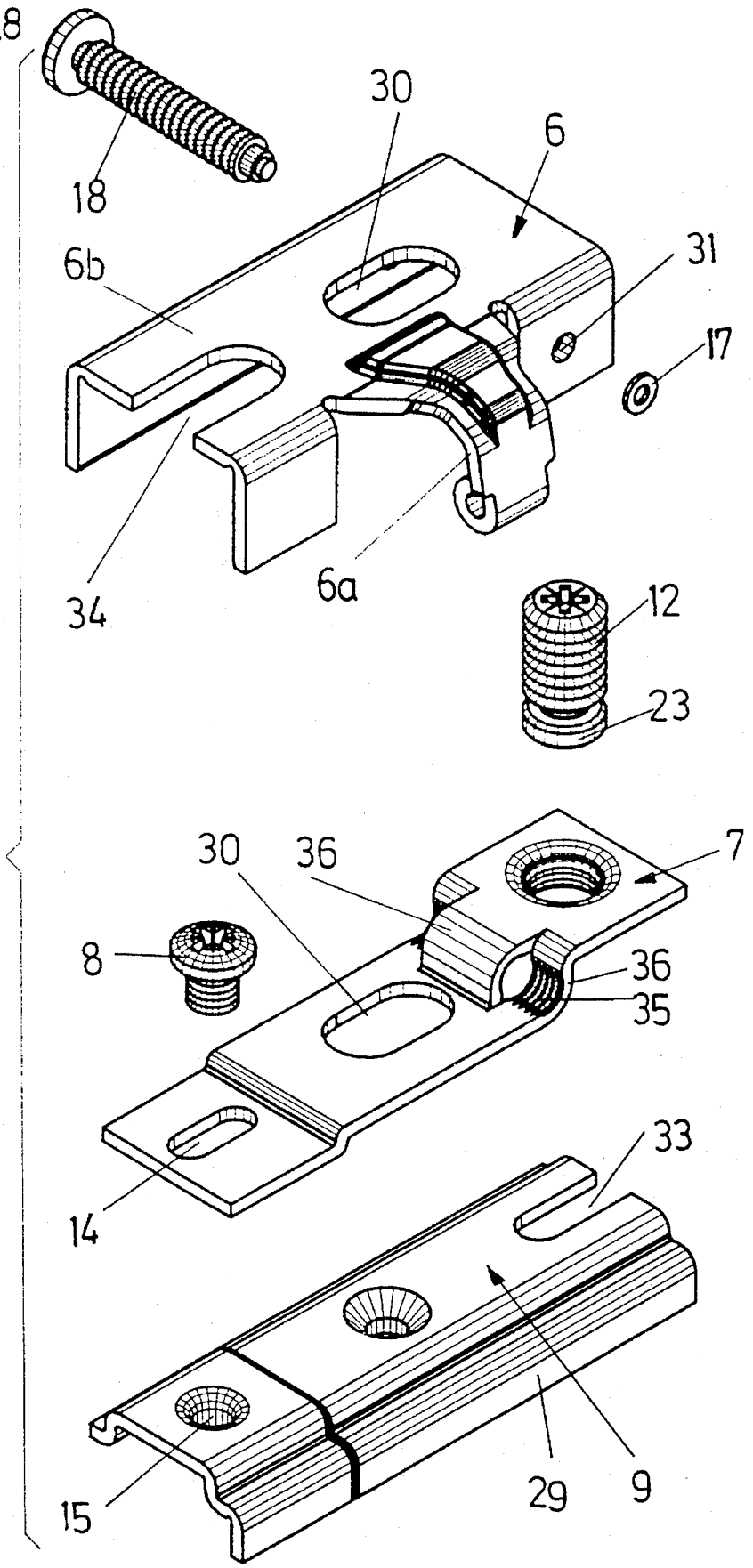
FIG. 8 is an exploded view of parts of the hinge according to FIG. 7.
Figure 9:
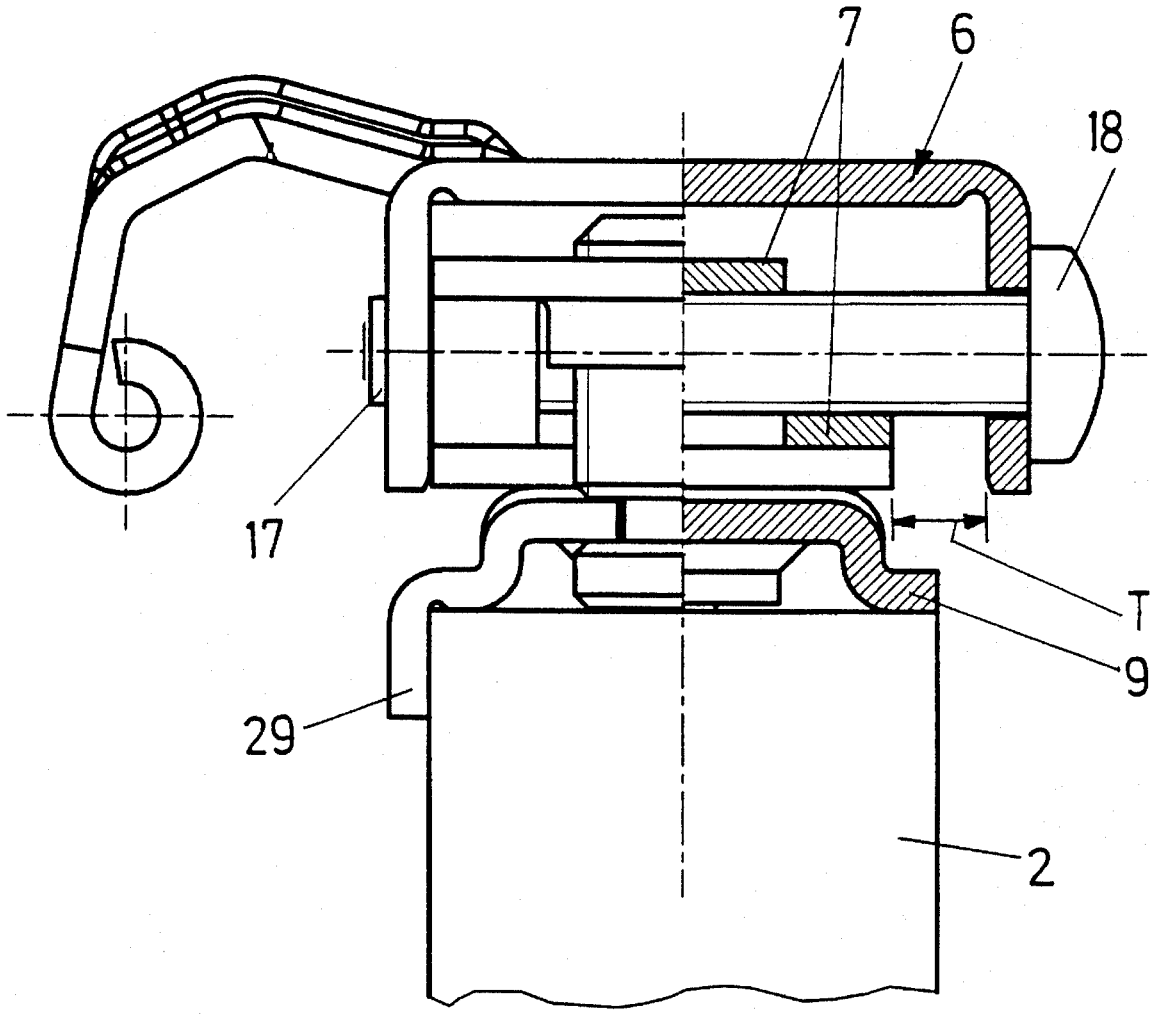
FIG. 9 is a cross-section through a hinge according to FIGS. 7 and 8, shown secured to a furniture frame.

The embodiment according to FIGS. 7–9 differs from the embodiment described above only inasmuch as the pin 18 by means of which the hinge arm 6 is articulated to the intermediate plate 7 is constructed as a threaded pin and the hinge arm 6 is of wider construction than the intermediate plate 7, with the result that the hinge arm 6 is adjustable by an amount t shown in FIG. 9 in the direction of the depth of the article of furniture, by turning the threaded pin 18. The female thread in the intermediate plate 7, which receives the threaded pin 18, in this case is formed by separate threaded portions 35 which are constructed on tabs 36 on the intermediate plate. In this case, the threaded pin 18 is held rotatably but axially non-displaceably in the hinge arm 6 and is secured by a washer 17.

We claim:

1. A frame hinge comprising:

a base plate to be mounted on a furniture frame;

an intermediate plate secured to said base plate by a securing screw;

a hinge pot to be mounted on a door leaf;

a hinge arm connected to said hinge pot by at least one pivot pin forming a hinge axis about which said hinge pot and the door leaf are pivotable between open and closed positions relative to said hinge arm and the furniture frame;

said intermediate plate having at least one projection extending into a slot in said hinge arm, thereby defining an articulation axis about which said hinge arm and said intermediate plate may be articulated with respect to each other, said articulation axis extending perpendicular to said hinge axis; and a gap-adjusting screw mounted on said base plate and threadedly engaged with one of said hinge arm and said intermediate plate, such that turning of said gap-adjusting screw causes articulation of said one of said hinge arm and said intermediate plate about said articulation axis relative to the other of said hinge arm and said intermediate plate.

2. A frame hinge as claimed in claim 1, wherein said securing screw comprises a clamping screw extending through an elongated hole in said intermediate plate, said elongated hole extending parallel to said hinge axis, and said clamping screw clamping said intermediate plate to said base plate.

3. A frame hinge as claimed in claim 1, wherein said intermediate plate has two projections extending into respective two slots in said hinge plate.

4. A frame hinge as claimed in claim 3, wherein said projections and edge surfaces of said hinge plate defining said slots are bent to extend in opposite directions.

5. A frame hinge as claimed in claim 1, wherein said gap-adjusting screw has a reduced diameter neck fitting in a slot in said base plate and a head retaining said gap-adjusting screw on said base plate.

6. A frame hinge as claimed in claim 5, wherein said slot in said base plate has an enlarged end of a size to permit passage therethrough of said head.

7. A frame hinge as claimed in claim 1, wherein said gap-adjusting screw is threaded into a female thread in said hinge arm and passes through an enlarged hole in said intermediate plate.

8. A frame hinge comprising:

a base plate to be mounted on a furniture frame;

an intermediate plate secured to said base plate by a securing screw;

a hinge pot to be mounted on a door leaf;

a hinge arm connected to said hinge pot by at least one pivot pin forming a hinge axis about which said hinge pot and the door leaf are pivotable between open and closed positions relative to said hinge arm and the furniture frame;

a threaded pin mounting said hinge arm on said intermediate plate, said pin defining an articulation axis about which said hinge arm and said intermediate plate may be articulated with respect to each other, said articulation axis extending perpendicular to said hinge axis, and said hinge arm being adjustable relative to said intermediate plate in a direction along said articulation axis; and a gap-adjusting screw mounted on said base plate and threadedly engaged with one of said hinge arm and said intermediate plate, such that turning of said gap-adjusting screw causes articulation of said one of said hinge arm and said intermediate plate about said articulation axis relative to the other of said hinge arm and said intermediate plate.

9. A frame hinge as claimed in claim 8, wherein said securing screw comprises a clamping screw extending through an elongated hole in said intermediate plate, said elongated hole extending parallel to said hinge axis, and said clamping screw clamping said intermediate plate to said base plate.

10. A frame hinge as claimed in claim 8, wherein said gap-adjusting screw has a reduced diameter neck fitting in a slot in said base plate and a head retaining said gap-adjusting screw on said base plate.

11. A frame hinge as claimed in claim 10, wherein said slot in said base plate is an open-ended slot.

12. A frame hinge as claimed in claim 8, wherein said gap-adjusting screw is threaded into a female thread in said intermediate plate.

13. A frame hinge as claimed in claim 8, wherein said threaded pin is rotatable relative to said hinge arm and is non-displaceable axially relative to said hinge arm.

14. A frame hinge as claimed in claim 13, wherein said threaded pin is threaded into a female thread in said intermediate plate.

15. A frame hinge as claimed in claim 14, wherein said female thread in said intermediate plate is formed by separate threaded portions on tabs of said intermediate plate.

16. A frame hinge comprising:

a base plate to be mounted on a furniture frame;

an intermediate plate secured to said base plate by a securing screw;

a hinge pot to be mounted on a door leaf;

a hinge arm connected to said hinge pot by at least one pivot pin forming a hinge axis about which said hinge pot and the door leaf are pivotable between open and closed positions relative to said hinge arm and the furniture frame;

said intermediate plate and said hinge arm being connected to articulate relative to each other about an articulation axis extending perpendicular to said hinge axis and to be perpendicular to the plane of the door leaf when said hinge pot is in said closed position;

a gap-adjusting screw having a head held on said base plate and a threaded portion threadedly engaged with one of said hinge arm and said intermediate plate, such that turning of said gap-adjusting screw causes articulation of said one of said hinge arm and said intermediate plate about said articulation axis relative to the other of said hinge arm and said intermediate plate; and said hinge arm having a T-shaped configuration including a base leg supporting said hinge axis and a cross leg supporting said articulation axis.

17. A frame hinge as claimed in claim 16, wherein said articulation axis is defined by at least one projection of said intermediate plate extending into a slot in said hinge arm.

18. A frame hinge as claimed in claim 17, wherein said intermediate plate has two projections extending into respective two slots in said hinge plate.

19. A frame hinge as claimed in claim 18, wherein said projections and edge surfaces of said hinge plate defining said slots are bent to extend in opposite directions.

20. A frame hinge as claimed in claim 16, wherein said securing screw comprises a clamping screw extending through an elongated hole in said intermediate plate, said elongated hole extending parallel to said hinge axis, and said clamping screw clamping said intermediate plate to said base plate.

21. A frame hinge as claimed in claim 16, wherein said gap-adjusting screw has a reduced diameter neck fitting in a slot in said base plate.

22. A frame hinge as claimed in claim 21, wherein said slot in said base plate has an enlarged end of a size to permit passage therethrough of said head.

23. A frame hinge as claimed in claim 21, wherein said slot in said base plate is an open-ended slot.

24. A frame hinge as claimed in claim 23, wherein said pin is threaded.

25. A frame hinge as claimed in claim 24, wherein said threaded pin is rotatable relative to said hinge arm and is non-displaceable axially relative to said hinge arm.

26. A frame hinge as claimed in claim 25, wherein said threaded pin is threaded into a female thread in said intermediate plate.

27. A frame hinge as claimed in claim 25, wherein said female thread in said intermediate plate is formed by separate threaded portions on tabs of said intermediate plate.

28. A frame hinge as claimed in claim 16, wherein said gap-adjusting screw is threaded into a female thread in said hinge arm and passes through an enlarged hole in said intermediate plate.

29. A frame hinge as claimed in claim 16, wherein said articulation axis is defined by a pin pivotally connecting said hinge arm to said intermediate plate.

30. A frame hinge as claimed in claim 16, wherein said gap-adjusting screw is threaded into a female thread in said intermediate plate.

* * * * *